United States Patent [19]

Barchi

[11] 4,337,035

[45] Jun. 29, 1982

[54] FIRING KILN; WITH EMPHASIS ON ROLLERS FOR A FIRING KILN

[75] Inventor: Rolfo Barchi, Castellon, Spain

[73] Assignee: Karl August Heimsoth Industrie, Hildesheim, Fed. Rep. of Germany

[21] Appl. No.: 207,733

[22] Filed: Nov. 17, 1980

[30] Foreign Application Priority Data

Nov. 26, 1979 [DE] Fed. Rep. of Germany ..... 2947540

[51] Int. Cl.[3] ..... F27D 3/00

[52] U.S. Cl. ..... 432/246; 432/236

[58] Field of Search ..... 432/235, 236, 245, 246

[56] References Cited

U.S. PATENT DOCUMENTS

| | | | |
|---|---|---|---|
| 2,014,302 | 9/1935 | Waldron | 432/246 |
| 2,175,834 | 10/1939 | Fatkin | 432/245 |
| 2,986,386 | 5/1961 | Trimborn | 432/246 |
| 3,338,569 | 8/1967 | Cuvelier | 432/246 |
| 3,608,876 | 9/1971 | Leaich | 432/246 |
| 4,205,746 | 6/1980 | Olson et al. | 432/246 |

FOREIGN PATENT DOCUMENTS

| | | | |
|---|---|---|---|
| 1282859 | 11/1968 | Fed. Rep. of Germany | 432/246 |
| 525513 | 8/1940 | United Kingdom . | |

*Primary Examiner*—John J. Camby

*Attorney, Agent, or Firm*—Lane, Aitken, Kice & Kananen

[57] ABSTRACT

A firing kiln, especially a tunnel kiln, in which ceramic components, especially tiles, are fired, with a roller conveyor with a large number of fixed but rotating rollers with a small diameter and at short intervals, for moving tiles into the kiln and out of it, and particularly through the firing zone of the kiln, wherein each of the rollers is constructed from a ceramic section with a metal cover, and each of the rollers is driven separately.

4 Claims, 8 Drawing Figures

FIRING KILN; WITH EMPHASIS ON ROLLERS FOR A FIRING KILN

Figure 1:
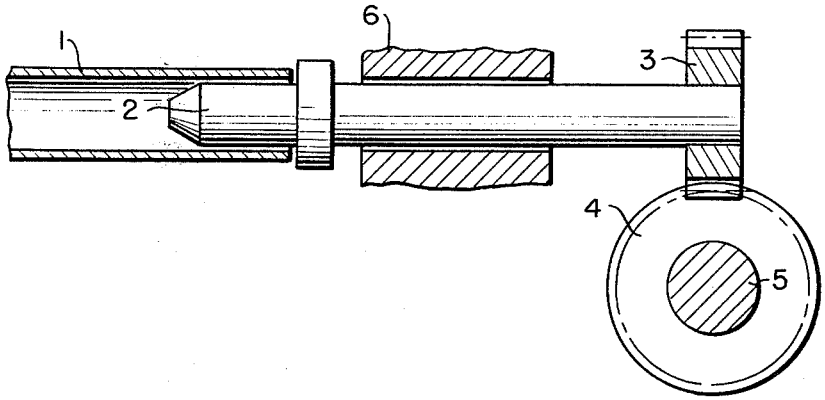

The invention relates to a firing kiln, with emphasis on the design of the rollers in a roller conveyor for a firing kiln.

In recent years, firing kilns have been constructed with a stationary roller conveyor, in order to move even smaller items for firing, namely tiles, through a firing kiln, if possible without a bed section. Compared to the usual tunnel kilns with conveyors, this method permits the achievement of a more productive manufacture. The rollers of such a roller conveyor have relatively small dimensions, e.g. 3 cm diameter; they are set at rather short intervals, e.g. with an average distance of 5 cm between neighboring rollers; and they have a free-standing length of about 1.50 meters between the side boundaries of the kiln.

With arrangement and dimensions of the rollers constituted that way, the roller cannot be prevented from losing its ideal cylindrical form and sagging more or less. In particular, if there is a stoppage due to a disruption in production, we must expect that the roller will sag downward from the effects of temperature, and take on a so-called wobble. Once a roller has taken on such a wobble, however, the tendency exists for this wobble to be aggravated in the course of further production. This can be explained by the fact that the drive chain customarily used in turning the roller permits the roller to turn rather quickly into the position in which the sag point of the roller is underneath. On the other hand, in the turning movement of the roller out of this position, a hesitation occurs, because the roller wants to remain in that position, because of its shape and the position of its center of gravity. The consequence of this wobble or of the progressive bending of the roller is that the rollers must be replaced rather often.

The purpose of the invention is to create a design of the rollers such that with firing kilns in accordance with the description in claim 1, no bending of the rollers occurs. Beyond that we want to ensure that if a roller has taken on a wobble, this wobble is not increased by further operation, but on the contrary is automatically reduced.

This effect is achieved by the instructions provided in the claims.

In one approach a ceramic member is used, which because of the temperature-stability of the material does not undergo any bending in the operation of the kiln. To be sure, a purely ceramic member cannot be used, because in the firing process it is to be feared that an adhesion (cementing) or a permeation (infiltration) will take place. Therefore in accordance with the invention, the ceramic member is provided with a separating cover. This may involve any suitable material; for example, a hollow cylinder of austenitic steel may be employed for this purpose, which need not contribute to the solidity of the roller, but does function as a means of separation.

In the second approach to the problem confronting the invention, each roller is driven separately; which stands in flat contradiction to the previous drive system using a common chain. By this individual drive we can ensure that the roller is turned at a uniform rate; in particular, that no forward slip or retardation of the roller takes place.

This individual drive can be implemented by a multitude of practical design devices, with special preference for driving the individual rollers by gear wheels, from a transverse shaft.

By constructing the roller in several sections, namely a drive section, the actual roller section in the kiln zone, and an additional bearing section, the replacement of a roller or the installation of a roller in circumferential orientation can easily be performed. It is also possible, working from the side of the kiln opposite the drive system, to separate the roller from the drive section. It can be replaced from there; but it can also be rotated, e.g. by 180°, especially when from any cause it has taken on a wobble. For this purpose markings on the roller or the bearing section may be useful.

There is also the point that because of the division in several sections, relatively cheap material can be employed where temperatures are low.

We now explain the invention with the aid of the illustrative drawings.

FIG. 1 gives a partial view of the bearing zone of a roller, as per invention.

Figure 2:
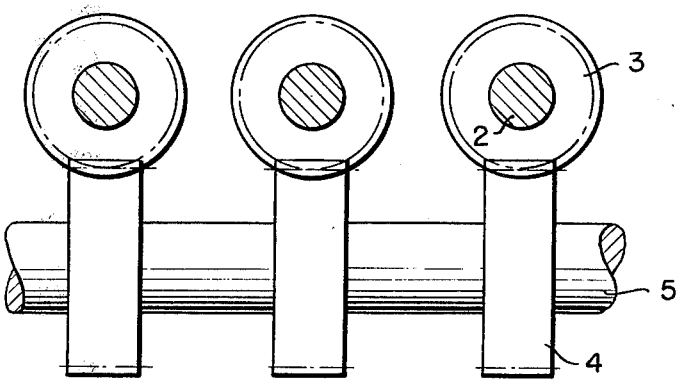

FIG. 2 gives a transverse view relative to FIG. 1.

Figure 3:
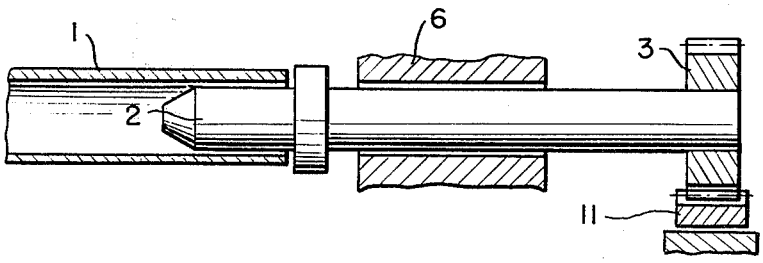

FIG. 3 gives a partial view of the bearing zone of a modified roller in accordance with the invention.

Figure 4:
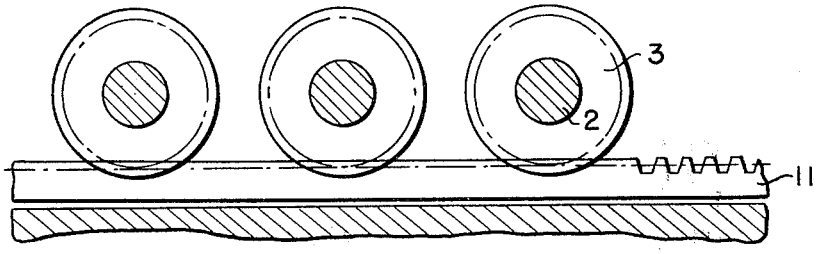

FIG. 4 gives a transverse view relative to FIG. 3.

Figure 5:
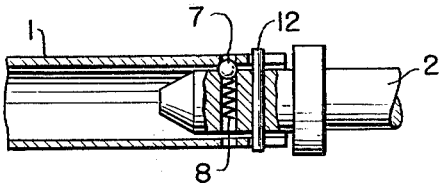

FIG. 5 gives a transverse view of a plug connection, as per invention.

Figure 6:
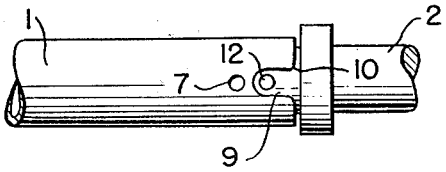

FIG. 6 gives a plan of the plug connection of FIG. 5.

Figure 7:
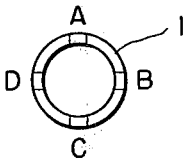

FIG. 7 gives a side view of a roller in accordance with the invention.

Figure 8:
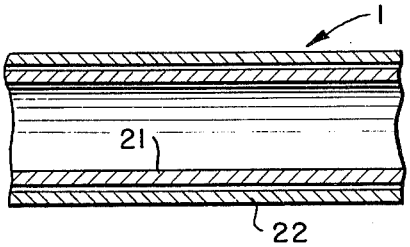

FIG. 8 shows a longitudinal cross-section of the middle part of a modified roller design in accordance with the invention.

In FIG. 1 a roller, 1, is displayed as a hollow cylinder. The left zone of the roller is the kiln zone, not shown. In the section where the reference number 1 is located, the roller goes through the side kiln wall, not shown. Located in the bearing section of roller 1 is a drive section, 2, which may consist of structural steel, for example. At the end of section 2 is a transverse-geared gear wheel, 3, which is set in engagement with a transverse-geared gear wheel, 4, on a shaft, 5, which drives it.

FIG. 1 also shows schematically the mounting 6 for roller 1 or for section 2.

FIG. 2 shows the shaft, 5, with three gear wheels, 4, each of which is set in engagement with gear wheels, 3, of section 2.

The modified design shown in FIGS. 3 and 4 has a link belt or gear chain, 11, which is set in engagement with the gear wheels, 3, of the sections 2.

It is clear that the gear wheels, 3, are driven by the movement of the link belt, 11.

FIGS. 5 and 6 show the method of connecting the actual roller, 1, with section 2. Section 2 has a cross pin, 12. It is further provided with a spring, 8, which is set in a cross boring. Located in the same cross boring is a ball, 7, which together with the spring and a matching boring in roller 1 constitutes a snap connection.

In addition, roller 1 is constructed with at least one slot, 9, which is rounded off at 10. This rounding off makes it possible to remove the roller 1 from its engagement with the cross pin 12, toward the left, while section 2 is being driven, and after a rotation of about 90° or 180° or such, to connect it with the drive again.

In order to perform this connection between the roller 1 and section 2 in the exact angular position, the roller or the bearing section may be provided with markings on the side opposite the drive side: for example, with four markings, A to D, as in FIG. 7.

FIG. 8 shows part of roller 1; this roller in this design is constructed with a ceramic tube, 21. This may involve a hollow cylinder, or else a solid cylinder. The ceramic section, 21, is provided with a temperature-stable (ca. 1100° C.) cover, 22, which is either pressed on solidly, or else surrounds the ceramic section, 21, with some clearance.

I claim:

1. In a firing kiln in which ceramic components are fired in a firing zone of the kiln, the improvement comprising the combination of:

(a) a roller conveyor with a large number of fixed but rotating rollers with a small diameter and at short intervals, for moving said ceramic components into the kiln and out of it, and particularly through the firing zone of the kiln;

(b) drive means engaging said rollers for driving each of said rollers; and (c) wherein each of said rollers is further defined as:

(1) constructed in at least two sections, a middle section and an end section, wherein said middle section is constructed of a ceramic member with a tubular cover made of austenitic steel or the like;

(2) each of said sections is adapted to be connected by plug connections;

(3) each of said end sections has a means for engaging said drive means;

(4) each of said end sections is provided with a cross pin and a ball-and-spring device; and,

(5) each of said middle sections is constructed with longitudinal slots distributed around the circumference to receive said cross pin and with borings distributed around the circumference for reception of the ball.

2. A firing kiln as defined in claim 1 wherein said drive means for driving said rollers comprises a transverse-geared gear wheel (3), mounted on each roller, and a common drive shaft (5) having a number of transverse-geared gear-wheel components (4) engaging the transverse-geared gear wheel for each roller.

3. A firing kiln as defined in claim 1 wherein said drive means for driving said rollers comprises a gear wheel (3) mounted on each roller and a common link belt or gear chain engaging the gear wheel for each roller.

4. A firing kiln as defined in claim 1 wherein the roller, or the end section of the roller which is opposite the drive side, is constructed with markings distributed around the circumference.

* * * * *